United States Patent [19]

Shimizu et al.

[11] Patent Number: 5,014,024

[45] Date of Patent: May 7, 1991

[54] BANDPASS FILTER AND METHOD OF TRIMMING RESPONSE CHARACTERISTICS THEREOF

[75] Inventors: Hiroyuki Shimizu; Kenji Ito; Naomasa Wakita, all of Nagoya, Japan

[73] Assignee: NGK Spark Plug Co., Ltd., Nagoya, Japan

[21] Appl. No.: 559,200

[22] Filed: Jul. 27, 1990

[30] Foreign Application Priority Data

Aug. 31, 1989 [JP] Japan ..... 1-227169

[51] Int. Cl.[5] ..... H01P 1/203; H01P 1/205

[52] U.S. Cl. ..... 333/203; 333/205

[58] Field of Search ..... 333/202-205, 333/219, 219.1

[56] References Cited

U.S. PATENT DOCUMENTS

| | | | |
|---|---|---|---|
| 4,157,517 | 6/1979 | Kneisel et al. | 333/205 |
| 4,288,530 | 9/1981 | Bedard et al. | 333/205 X |
| 4,418,324 | 11/1983 | Higgins | 333/205 X |
| 4,963,843 | 10/1990 | Peckham | 333/203 |

*Primary Examiner*—Eugene R. Laroche
*Assistant Examiner*—Seung Ham
*Attorney, Agent, or Firm*—Darby & Darby

[57] ABSTRACT

A bandpass filter is disclosed which comprises a pair of opposing, first and second dielectric substrates each having an outer surface provided with a ground conductor, and a conducting resonator member provided between the first and second dielectric substrates and including a plurality of parallel resonator fingers each having an open circuit end and a base end electrically connected to said ground conductor, characterized in that a part of the ground conductor is removed to form an opening therein between adjacent two fingers, thereby to increase the bandwidth of frequency to which the filter responds.

4 Claims, 4 Drawing Sheets

BANDPASS FILTER AND METHOD OF TRIMMING RESPONSE CHARACTERISTICS THEREOF

This invention relates to a stripline filter and a method of trimming the response characteristics thereof.

In general, stripline filter includes a pair of opposing, first and second dielectric substrates each having an outer surface provided with a ground conductor, and spaced conducting resonator conductor layers provided between said first and second dielectric substrates and each having an open circuit end and a base end electrically connected to the ground conductor. Such a filter is utilized as a bandpass filter in a microwave region.

The bandwidth of frequencies to which such a filter responds depends on the distance between the resonator conductor layers. Thus, the bandwidth is increased by narrowing the space between the resonator layers so as to increase the degree of coupling therebetween, while the bandwidth is decreased by widening the space so as to decrease the degree of coupling between the resonator layers. Since the resonator conductor layers are sandwiched between two dielectric substrates, it is quite difficult to trim the frequency bandwidth of the filter after formation thereof into a unitary structure.

U.S. Pat. No. 4,157,517 discloses a stripline filter of the above-mentioned type in which, as shown in FIG. 8, a portion *y* of the ground conductor adjacent to open circuit ends 2*b* is removed to form an opening therein so that the resonance frequency of the filter is adjusted to a predetermined frequency. While the resonance frequency can be thus trimmed according to this prior art technique after fabrication of the filter, it is not possible to trim the bandwidth of frequency to which the filter responds. The trimming of the bandwidth is as important as the tuning of the resonance frequency in order to obtain desirable response characteristics of the filter.

The present invention is aimed at the provision of a stripline or microstripline filter whose frequency bandwidth is trimmed after fabrication thereof.

In accordance with one aspect of the present invention, there is provided a bandpass filter comprising a pair of opposing, first and second dielectric substrates each having an outer surface provided with a ground conductor, and conducting resonator means provided between said first and second dielectric substrates and including a plurality of parallel resonator fingers each having an open circuit end and a base end electrically connected to said ground conductor, characterized in that a part of said ground conductor is removed to form an opening therein between adjacent two fingers, thereby to increase the bandwidth of frequency to which said filter responds.

In another aspect, the present invention provides a method of trimming the response characteristics of a bandpass filter comprising a pair of opposing, first and second dielectric substrates each having an outer surface provided with a ground conductor, and conducting resonator means provided between said first and second dielectric substrates and including a plurality of parallel resonator fingers each having an open circuit end and a base end electrically connected to said ground conductor, characterized by the step of removing a portion of said ground conductor between adjacent two resonator fingers to increase the bandwidth of frequency to which said filter responds.

The present invention will now be described in detail below with reference to the accompanying drawings in which.

Figure 6:
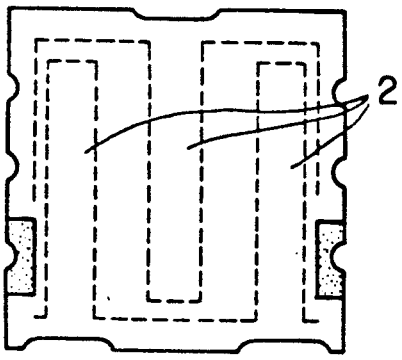
FIG. 6 PRIOR ART
Figure 7:
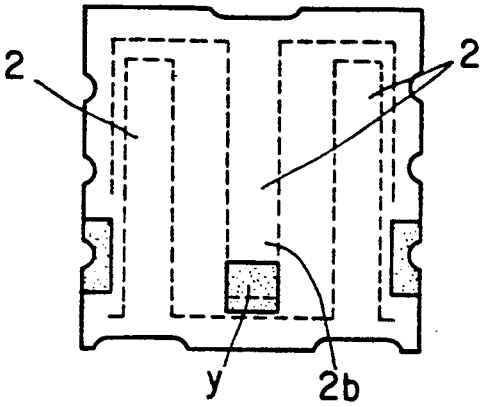
FIG. 7 PRIOR ART
Figure 8:
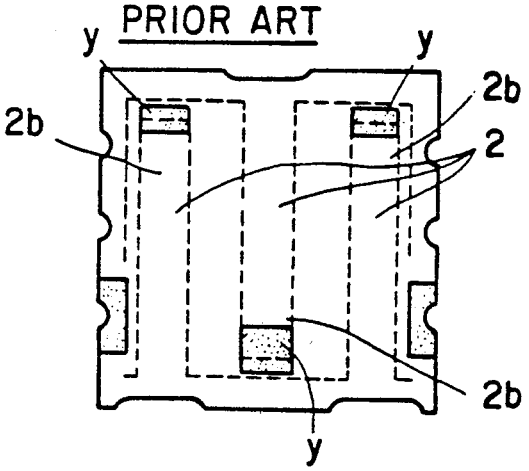
FIG. 8 PRIOR ART
Figure 9:
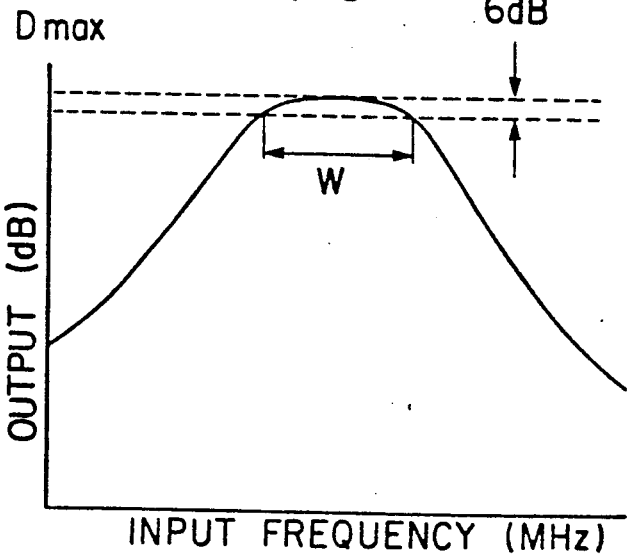

FIGS. 3(*a*), 3(*b*), 3(*c*), 4(*a*), 4(*b*), 5(*a*) and 5(*b*) are plan views schematically showing embodiments of the present invention with various patterns of openings formed in ground conductors thereof;

FIG. 6 is a plan view showing a conventional filter having no openings;

FIGS. 7 and 8 are plan views showing conventional filters having an opening or openings in ground conductors; and FIG. 9 is an input frequency vs. output curve showing the response characteristics of the filter of FIG. 5(*b*).

Figure 1:
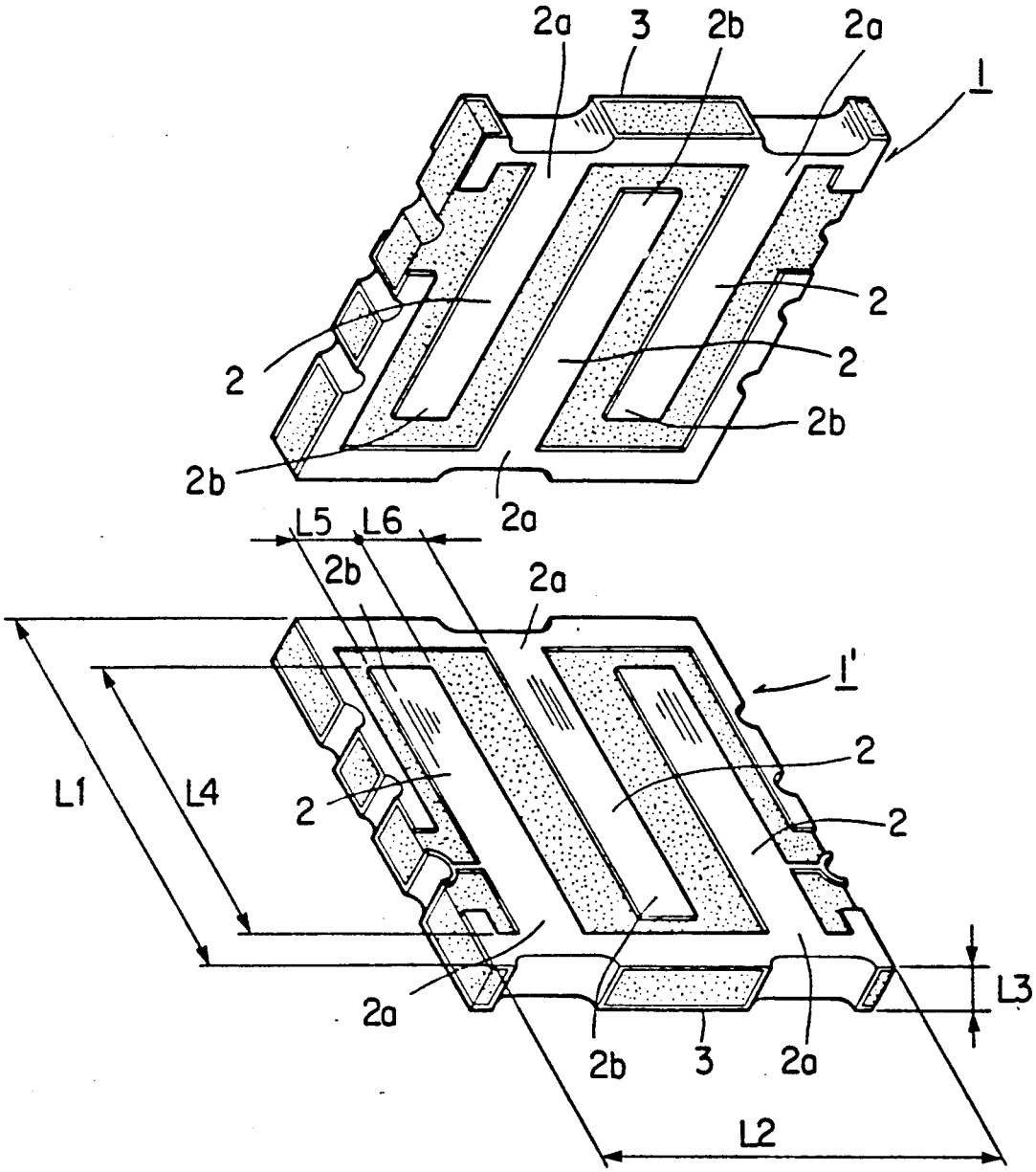
FIG. 1 is an exploded, perspective view schematically showing one example of a bandpass filter embodying the present invention.
Figure 2:
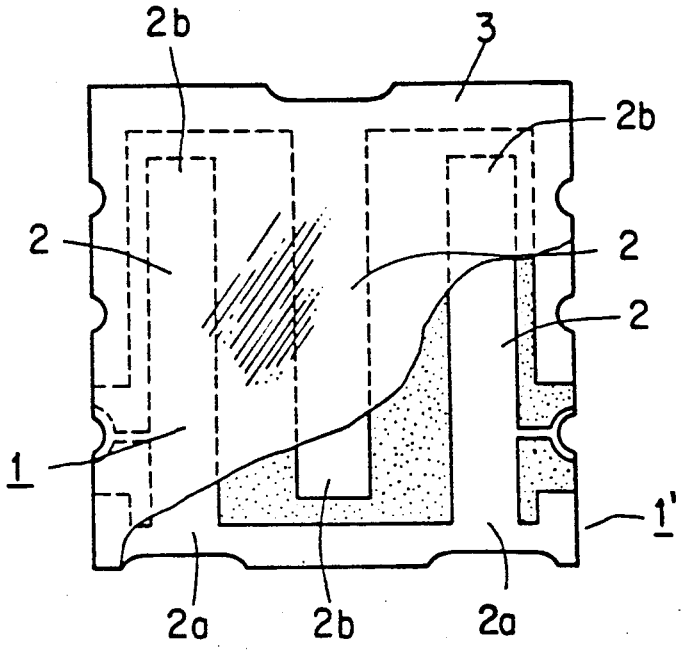
FIG. 2 is a perspective view, cut away in part, of the bandpass filter of FIG. 1 in an assembled state.

Referring now to FIGS. 1 and 2, designated as 1 and 1' are upper and lower dielectric substrates each formed of a dielectric ceramic having a high dielectric constant and a low loss, such as $BaO\text{-}TiO_2$ or $BaO\text{-}TiO_2$-rare earth. Each of the dielectric substrates 1 and 1' has a surface provided with a ground conductor 3. The two substrates 1 and 1' are laminated with their ground conductors 3 forming both outer surfaces. A conducting resonator member 2 having a plurality of fingers (three fingers in the illustrated case) is formed on an inner surface of each of the substrates 1 and 1'. Each finger has a base portion 2*a* electrically connected to the ground conductor 3 with the other end thereof terminating to form an open circuit end 2*b*. These fingers are arranged in an alternate, interdigital form. The two resonator members 2 of respective dielectric substrates 1 and 1' are arranged in a mirror image relation and, in an assembled state, are disposed in face contact with each other to form a resonator means between the two substrates 1 and 1'.

The construction of the resonator means is not limited only to the above. For example, the resonator member 2 may be formed on only one of the two subtrates 1 and 1', if desired. Further, the fingers of the resonator means may be arranged in a comb-line pattern.

The present invention is characterized in that a part of the ground conductor 3 is removed to form an opening therein between adjacent two fingers, thereby to increase the bandwidth of frequency to which the filter responds.

FIGS. 3(*a*), 3(*b*) and 3(*c*) show embodiments of the present invention which are obtained by providing openings x in a ground conductor layer of the conventional filter shown in FIG. 6 which has no openings. More particularly, in the filter of FIG. 3(*a*), two elongated openings *x* are formed in the ground conductor along both sides of the center finger and extending between the center finger and the two side fingers and in parallel therewith. In the embodiment of FIG. 3(*b*), two openings *x* are formed over the top of the center finger, while in the embodiment of FIG. 3(*c*), the two openings of FIG. 3 (*b*) are merged to form a single elongated opening extending perpendicularly to the axis of the fingers.

In the filter shown in FIG. 7, an opening *y* is provided adjacent to the circuit end 2*b* of the center finger according to U.S. Pat. No. 4,157,517. In the embodiment of FIG. 4(*a*), an opening *x* is additionally provided between the center finger and one of the side fingers. Openings *x* are provided, in the embodiment of FIG. 4(*b*), between the center finger and both of the side fingers.

The filter shown in FIG. 8 is the conventional filter disclosed in U.S. Pat. No. 4,157,517, wherein openings y are formed in the ground conductor layer at positions adjacent to respective open circuit ends 2*b*. In the embodiments shown in FIGS. 5(*a*) and 5(*b*), openings x are formed in addition to the openings y.

Significance of the formation of openings x between adjacent two fingers will be appreciated from the following examples, wherein filters having ground conductors with or without openings x as shown in FIGS. 3–8 were tested for their response characteristics. The filters had the same structure except for their patterns of openings. Thus, the dielectric substrate 1 (1') had a size ($L_1xL_2xL_3$, see FIG. 1) of 11.5x11.5x1.2 mm. The resonator finger had a size ($L_4xL_5$) of 8.7x1.5 mm and the inter-finger distance $L_6$ was 2.2 mm. The dielectric constant and the non-load $Q_m$ of the dielectric substrate 1 (1') were 93 and 2,000, respectively. The output (dB) of the filter was measured at various input frequencies (MHz) and this relationship was shown as an input frequency vs. output curve plotted with the frequency as abscissa and the output as ordinate. The bandwidth W (MHz) is a range of the abscissa in which the output is not less than ($D_{max}-6$ dB), where $D_{max}$ is the maximum output (dB) of the filter. The input frequency-output curve in the case of the filter of FIG. 5(*b*) is shown in FIG. 9. The test results were as summarized in Table below.

TABLE

Figure 3A:
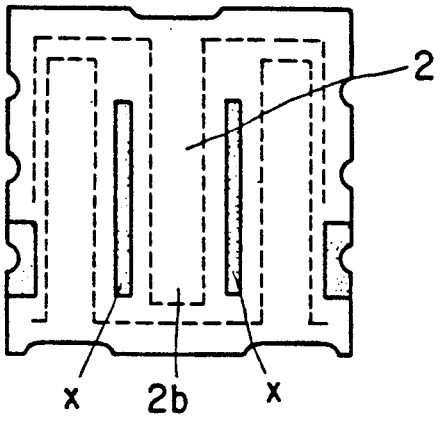
Figure 4A:
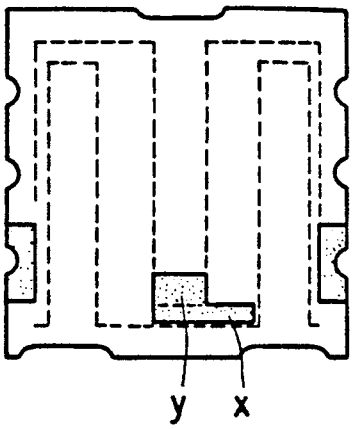
Figure 3B:
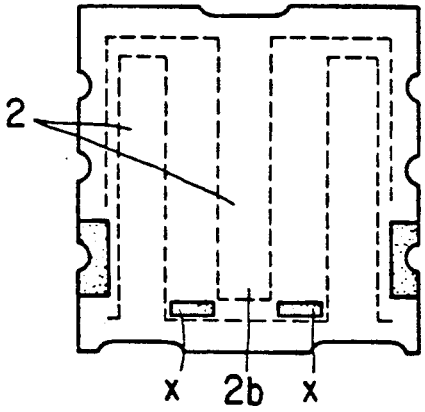
Figure 4B:
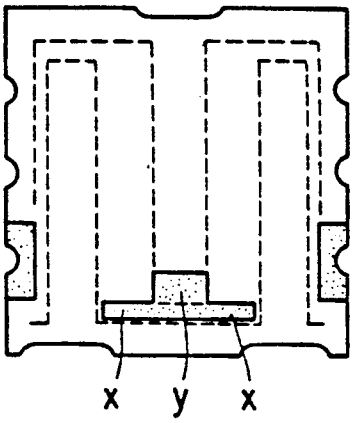
Figure 3C:
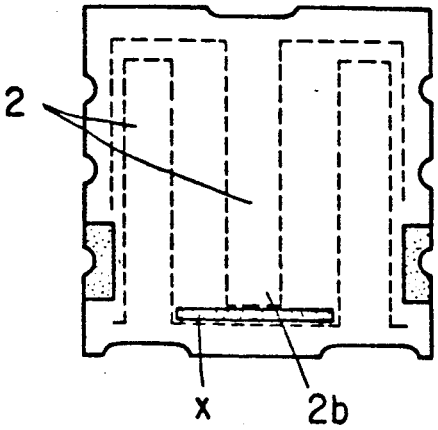
Figure 5A:
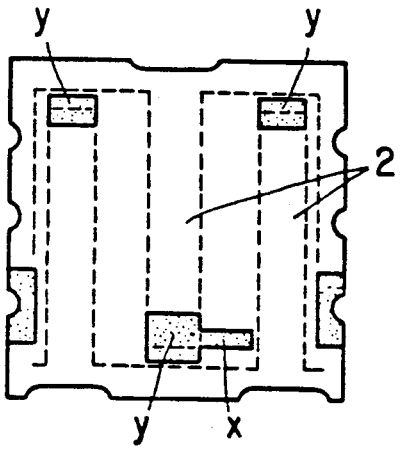
Figure 5B:
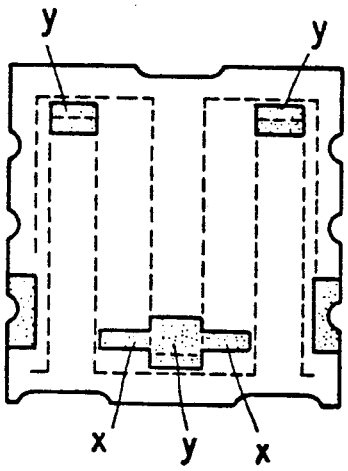

| Filter | Center Frequency (MHz) | Insertion Loss (dB) | Bandwidth (MHz) |
|---|---|---|---|
| FIG. 6 | 836.61 | 5.02 | 25.15 |
| FIG. 3(a) | 836.71 | 5.04 | 26.00 |
| FIG. 3(b) | 836.05 | 5.56 | 27.51 |
| FIG. 3(c) | 835.67 | 5.44 | 29.84 |
| FIG. 7 | 837.53 | 6.21 | 26.44 |
| FIG. 4(a) | 837.25 | 5.80 | 27.23 |
| FIG. 4(b) | 836.50 | 5.01 | 29.15 |
| FIG. 8 | 836.60 | 5.55 | 26.75 |
| FIG. 5(a) | 836.10 | 5.41 | 27.99 |
| FIG. 5(b) | 835.05 | 5.35 | 30.26 |

From the results summarized in Table above, it will be appreciated that the formation of openings x between adjacent two fingers can increase the bandwidth. More particularly, the filters according to the present invention shown in FIGS. 3(*a*)–3(*c*) exhibit greater bandwidths in comparison with the filter of FIG. 6. Similarly, the filters shown in FIGS. 4(*a*)–4(*b*) and FIGS. 5(*a*)–5(*b*) have greater bandwidths in comparison with those of FIG. 7 and FIG. 8, respectively. This is presumably attributed to an increase in coupling between the two resonator fingers caused by the formation of the opening therebetween. The magnitude of the increase in bandwidth may be controlled by the number and/or area of the opening x.

The absolute values of the bandwidth and center frequency of filters considerably vary even with a slight variation in the shape of the conductor fingers thereof and the thickness thereof. Thus, it is necessary to measure the response characteristics of filters after fabrication thereof. Based on the results of the measurement, the bandwidth is controlled by the formation of openings x. If control of the resonance frequency is also desired, it is convenient to form openings y according to the conventional techniques. Since, in the above examples, the filters of FIGS. 6–8 were prepared from the different precursor filter, comparison of the center frequencies in the above Table has no meaning.

The opening x may be formed with any suitable means such as a cutter, sand blast or laser beam. The opening x is generally formed in one ground conductor which forms one of the both outer surfaces of the filter.

We claim:

1. A bandpass filter comprising a pair of opposing, first and second dielectric substrates each having an outer surface provided with a ground conductor, and conducting resonator means provided between said first and second dielectric substrates and including a plurality of parallel resonator fingers each having an open circuit end and a base end electrically connected to said ground conductor, characterized in that a part of said ground conductor is removed to form an opening therein between adjacent two fingers, thereby to increase the bandwidth of frequency to which said filter responds.

2. A bandpass filter according to claim 1, wherein said resonator means has three resonator fingers including two, side resonator fingers and an intermediate resonator finger disposed between said side resonator fingers and wherein said opening is formed adjacent to the open circuit end of said intermediate resonator finger on at least one of the both sides of said intermediate resonator finger.

3. A bandpass filter according to claim 2, wherein said resonator fingers are arranged in a interdigital form.

4. A method of trimming the response characteristics of a bandpass filter comprising a pair of opposing, first and second dielectric substrates each having an outer surface provided with a ground conductor, and conducting resonator means provided between said first and second dielectric substrates and including a plurality of parallel resonator fingers each having an open circuit end and a base end electrically connected to said ground conductor, characterized by the step of removing a portion of said ground conductor between adjacent two resonator fingers to increase the bandwidth of frequency to which said filter responds.

* * * * *